US006722656B2

(12) United States Patent
Heglund, Jr.

(10) Patent No.: US 6,722,656 B2
(45) Date of Patent: Apr. 20, 2004

(54) JOUSTING APPARATUS

(76) Inventor: Albert Heglund, Jr., 1225 NW. Elford Dr., Seattle, WA (US) 98177-4130

( * ) Notice: Subject to any disclaimer, the term of this patent is extended or adjusted under 35 U.S.C. 154(b) by 0 days.

(21) Appl. No.: 10/073,499

(22) Filed: Feb. 11, 2002

(65) Prior Publication Data

US 2003/0151203 A1 Aug. 14, 2003

(51) Int. Cl.[7] ..... A63B 67/00; A63F 9/00

(52) U.S. Cl. ..... 273/451; 463/47.5; 482/906

(58) Field of Search ..... 273/451, 452, 273/440, 440.1, 453, 459; 463/47.2, 47.4, 47.5; 482/906; 473/551

(56) References Cited

U.S. PATENT DOCUMENTS 2,937,023 A * 5/1960 Seymour et al. ..... 119/769
3,323,796 A * 6/1967 Carlson ..... 273/451
3,608,899 A * 9/1971 Hall ..... 463/47.5
4,070,023 A * 1/1978 Cutler ..... 463/47.5
4,132,408 A * 1/1979 Sabat ..... 463/47.5
4,462,593 A * 7/1984 Carty, Jr. ..... 463/47.5
4,682,774 A * 7/1987 Holy ..... 463/47.5
5,524,886 A * 6/1996 Kim ..... 463/47.5
5,938,532 A * 8/1999 Wall ..... 224/267
2001/0019967 A1 * 9/2001 Taylor ..... 463/47.2

* cited by examiner

*Primary Examiner*—Raleigh W. Chiu
(74) *Attorney, Agent, or Firm*—Jensen & Puntigam, P.S.

(57) ABSTRACT

The improved jousting apparatus includes two sticks which are joined together with a flexible rope-like connecting member which is anchored within the ends of the respective sticks. The connecting member is long enough to allow motion of the two sticks relative to each other. Each stick includes two positioning rings along the length thereof, the upper ring identifying a normal position for the upper hand of each contestant, the first and second rings together identifying a first disadvantaged position for a selected contestant, and the second ring identifying a further disadvantaged position for the selected contestant.

3 Claims, 3 Drawing Sheets

FIG. 1
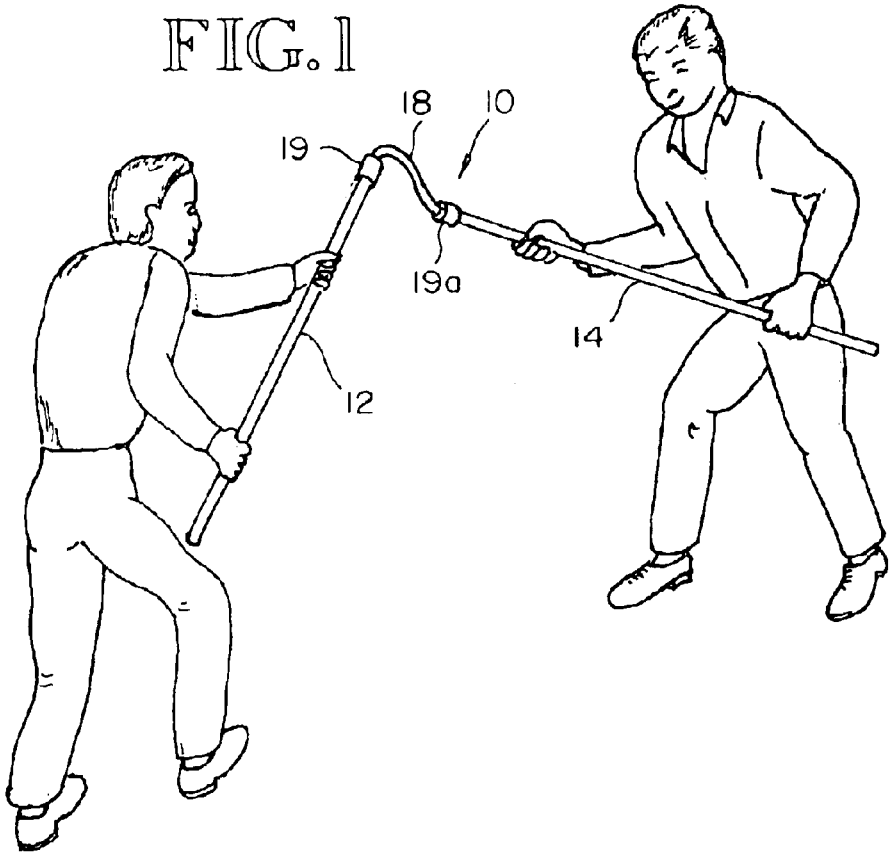
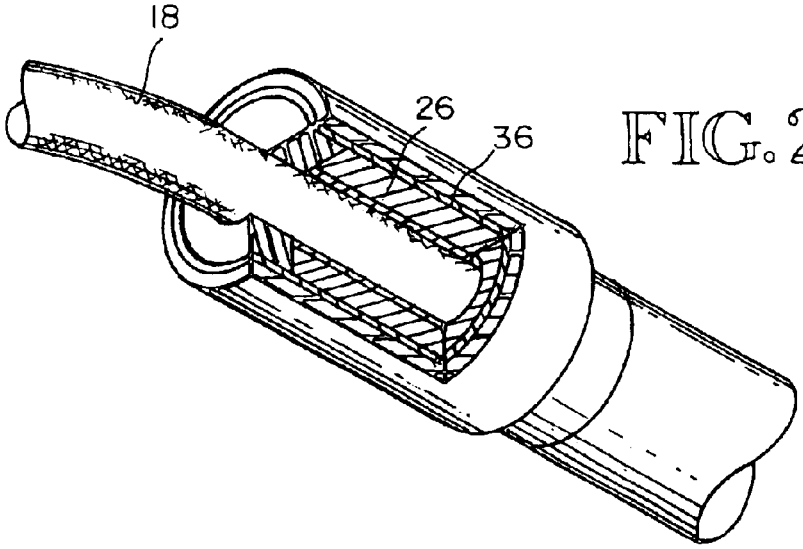
FIG. 2

JOUSTING APPARATUS

TECHNICAL FIELD

This invention relates generally to recreational equipment, and more particularly concerns a jousting apparatus involving two jousting sticks connected by a flexible rope-like connecting member.

BACKGROUND OF THE INVENTION

This invention is an improvement on U.S. Pat. No. 3,323,796, which is described in more detail below. Briefly, the '796 apparatus comprises two hand-holdable sticks, which are joined by a comparatively short, flexible connecting member, the ends of which are anchored in adjacent ends of the two sticks, thereby forming a continuous apparatus. The '796 apparatus can be used conveniently by two persons in a jousting contest which involves physical strength, skill and agility. While the invention of the '796 patent has proven to be successful, there is no basis in that invention for providing an advantage to one contestant so as to equalize what would otherwise be a mismatch in physical prowess/agility.

This invention provides such a capability in the context of the '796 apparatus. This invention thus enables the prior jousting apparatus to be successfully and fairly used by contestants who are not matched in physical prowess, thus expanding the enjoyment of the apparatus.

DISCLOSURE OF THE INVENTION

Accordingly, the present invention is an improved jousting apparatus which comprises two elongated sticks which are joined together with a flexible connecting member anchored within the respective stick ends, wherein the connecting member is anchored sufficiently to allow relative motion to the respective sticks, wherein each jousting stick includes two designations placed at predetermined positions along the length of each stick, wherein the designations provide a selected positioning for an upper hand of a selected contestant in three positions: a first position which is a normal position for a jousting contest, a second position below the first position which is for a disadvantage to the selected contestant in the jousting contest, and a third position below the second position, which is for a further disadvantage to the selected contestant in the jousting contest.

BRIEF DESCRIPTION OF THE DRAWINGS

FIG. 1 is a perspective view of the jousting apparatus of the present invention showing participants in the jousting game.

FIG. 2 is an enlarged partially cut-away view showing the anchoring structure holding the flexible member in place between the ends of the two jousting sticks of FIG. 1.

BEST MODE FOR CARRYING OUT THE INVENTION

Figure 3:
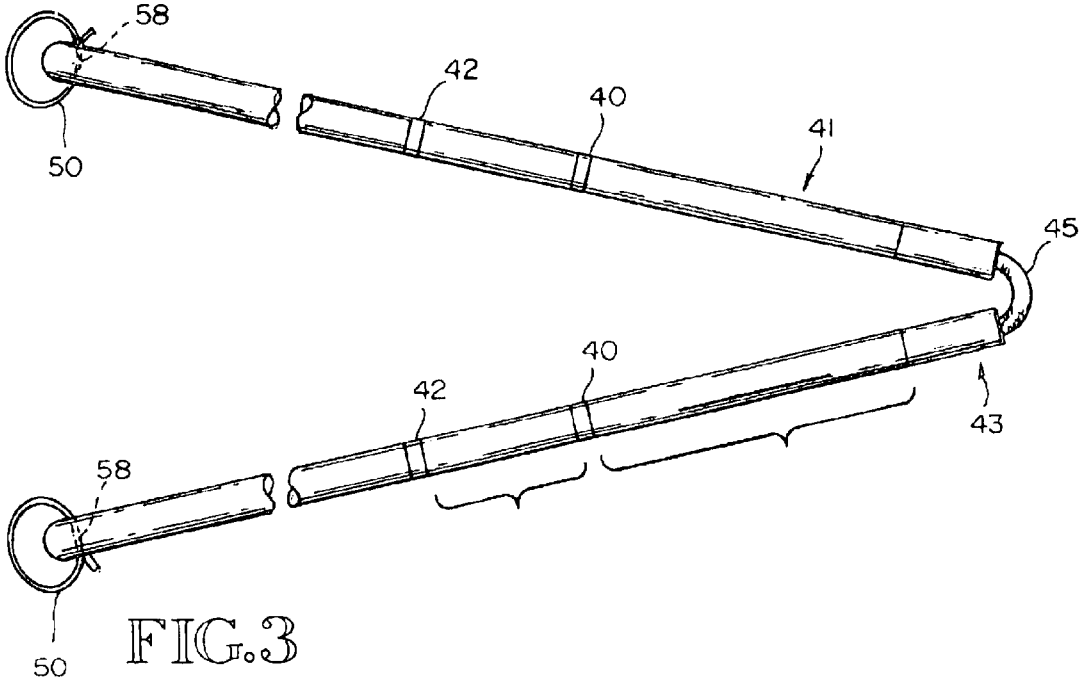
FIG. 3 shows in detail the improved jousting apparatus of the present invention.

FIG. 1 shows a jousting apparatus 10, described in the '796 patent. Each jousting stick 12 and 14 is preferably of a length which is approximately waist-high of the participants. Shorter length sticks can be provided for children. Conversely, longer sticks can be provided for exceptionally tall contestants. The sticks 12, 14 are made preferably from wood, but aluminum tubing or other similar elements can also be used. The exterior of the sticks 12, 14 is preferably round to accommodate hand-gripping, but other cross-sectional shapes, such as hexagonal, could also be used.

The connecting member 18 is preferably rope-like, in its appearance and characteristics, and may be made of either natural or man-made materials. The material must be flexible and strong. One example of such material is braided polypropylene. The length of the connecting member 18 between the free ends 19, 19*a* of the two sticks 12 and 14 is typically approximately ⅓th the length of the stick, although this can be varied to some extent. As seen in FIG. 2, each end of the connecting member 18 is anchored into a recess 26 in the stick 12, 14, respectively. The recesses are each about two inches in depth and of an oversize diameter to accommodate securing materials. Such a structure is preferable to hooks and eyelets, which could harm a contestant.

The ends of the connecting member 18 are anchored within the recesses 26 by a securing element, such as epoxy resin 36, which fills the over-size diameter clearance volume around the respective connecting member 18. To enhance the securing material's holding power and appearance, such epoxy resin is spread on the ends 19, 19*a* of each stick, on the surface area remaining around the connecting member 18. A ferrule 36 is positioned in the end of each jousting stick around the inserted connecting member 18 and positioned to extend beyond the end of the stick defining cavity 26 to receive the bonding epoxy resin. The ferrule 36 could be made of a light gauge metal, but is preferably a plastic sleeve, such as ABS plastic. The plastic sleeve contains the epoxy resin which secures the connecting member 18. The epoxy resin will not wick upwardly in the braided polypropylene beyond the end of each stick. The epoxy resin provides a secure anchoring of the connecting member to the adjacent ends of the jousting sticks.

FIGS. 3–7 show modifications of the apparatus of FIG. 1. Referring to FIG. 3, in particular, two rings 40 and 42 are added to each jousting stick 41 and 43, which are connected by flexible member 45. The jousting sticks and the connecting member are otherwise like that of FIG. 1. The first ring 40 on each stick is positioned approximately 10 inches or so from the connecting member end 19, 19*a* thereof. A second ring 42 on each stick is positioned approximately 5–6 inches below the first ring 40. The rings themselves can be identified by various means, including paint or tape or any other convenient element. In the embodiment shown, the rings are approximately ⅜ inch wide, although this dimension can vary.

Figure 4:
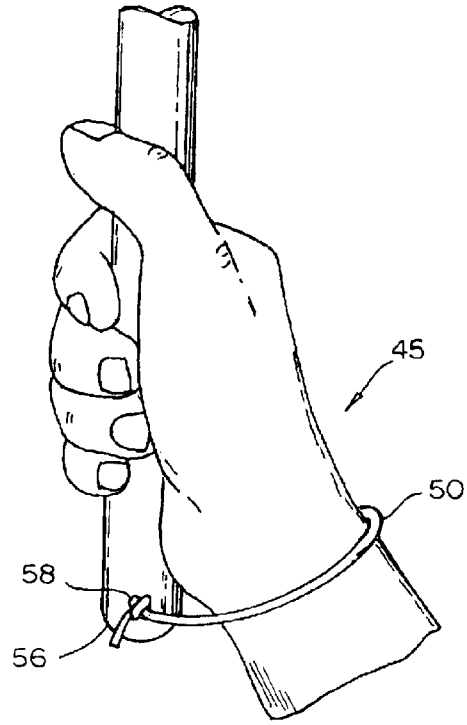
FIG. 4 shows one particular feature of the improved jousting apparatus in use.

At the bottom of each jousting stick is attached a thong 50 (FIG. 4). In the embodiment shown, the thong is of leather or other flexible cording and is securely attached to each jousting stick in the vicinity of the lower end thereof. Thong 50 is long enough to permit an individual to put one hand and wrist 45 therethrough and to grip the stick at the lower free end 56 thereof, as shown in FIG. 4. Typically, a hole 58 will be drilled through each stick at the free end 56 thereof, and the thong 50 is positioned therethrough and tied or otherwise fastened to provide a loop. Other attaching means, however, such as a clamp, could be used.

Figures 5, 6, 7:
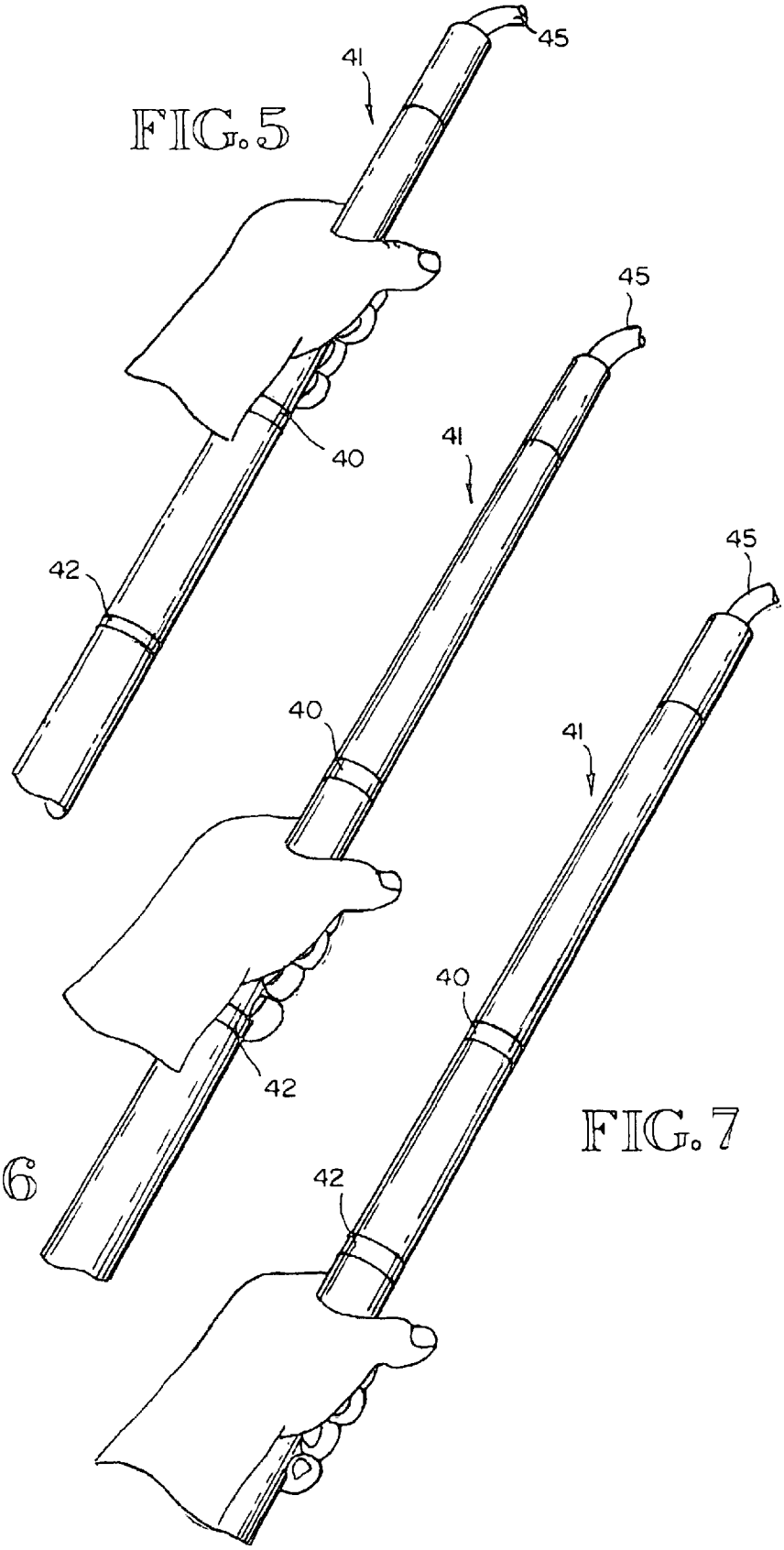
FIG. 5 shows a typical gripping arrangement in use for one of the contestants.
FIG. 6 shows a first alternative gripping arrangement in use by one of the contestants.
FIG. 7 shows a second alternative gripping arrangement in use by one of the contestants.

As indicated above, rings 40, 42 are designed to provide an advantage to one of the contestants. In use, both contestants will typically start in an "equal" or normal position, i.e. neither contestant has an advantage relative to the grasping of the stick. Each contestant places one hand above the first (top) ring 40, i.e. so that the lower edge of the hand is just adjacent the top ring. This is shown in FIG. 5. The contestant extends the other hand through the thong loop 50 at the bottom of the same stick; that hand grips the stick at the lower end thereof. The first jousting contest then occurs. If one party is to be given an advantage in the jousting contest, such as for instance the loser in a first contest, the winner in that previous contest, i.e. the party to be put at a disadvantage, lowers his/her upper hand to a position between the two rings 40 and 42. This provides an advantage, i.e. an increased fulcrum effect, to the other party, thereby giving the other party a better opportunity to win the next contest. This arrangement is shown in FIG. 6.

A further advantage can be provided, if desired, such as if the first winner wins again, by the winning party dropping his/her upper hand down below the second ring 42, such that the upper edge of the hand is adjacent the second ring. This increases the fulcrum advantage to the other party to another significant level. This arrangement is shown in FIG. 7. The contest then proceeds on that basis.

The improved game provides a structural basis for shifting the advantage of the game between the two contestants, presumably because of unequal physical prowess. Contestants who may be temporarily weakened can continue to play the game, particularly against usual opponents who are a fair match under normal circumstances but may have an advantage under present conditions. The device teaches a jousting skill and encourages the contestant's ability to assess an opponent's actions as well as providing an opportunity to partake in the development of reactive, healthful skills. The improved game need not require the contestants to start out in the normal position. They could start in any agreed position.

In a minor variation of the apparatus, gripping elements (rubber or the like) could be positioned at the three normal hand positions. This is not necessary to the improved game, however.

Accordingly, an improvement on the jousting game shown in the '796 patent has been described, providing an advantage to one party under specific conditions in an attempt to equalize inequalities between the two contestants.

Although a preferred embodiment of the invention has been disclosed here for purposes of illustration, it should be understood that various changes, modifications and substitutions may be incorporated without departing from the spirit of the invention, which is defined by the claims which follow.

What is claimed is:

1. An improved jousting apparatus, comprising:

two elongated sticks joined together with a flexible connecting member anchored within the respective stick ends, wherein the elongated sticks are at least as long as the distance from a waist of a user to the ground, and wherein the connecting member is anchored within the stick ends to prevent movement of the sticks relative to the connecting member, both rotationally and longitudinally, wherein the connecting member is long enough and anchored sufficiently to allow motion of the respective sticks relative to each other and permit the apparatus to be used for jousting, wherein each jousting stick includes a first designation located approximately 10 inches from an upper end of the stick, wherein there are no designations between the upper end of the stick and the first designation and a second designation located within the range of 5–6 inches below the first designation, wherein there are no designations between the first and second designations, wherein the designations provide selected positioning for an upper hand of a selected contestant in three positions: a first position which is a normal position for a jousting contest for both the selected contestant and an opponent, a second position below the first position which provides a disadvantage to the selected contestant in the jousting contest relative to the opponent in said first position and a third position below the second position, which provides a further disadvantage to the selected contestant relative to the opponent said first position.

2. An apparatus of claim 1, wherein in the first position, a lower edge of the upper hand is positioned adjacent the first designation, wherein in the second position the upper hand is located between the two designations, and in the third position an upper edge of the hand is located adjacent the second designation.

3. An apparatus of claim 1, wherein each stick includes a flexible thong element at a lower end thereof, formed into a loop through which a contestant extends the other hand to grip a lower end of the stick.

* * * * *

UNITED STATES PATENT AND TRADEMARK OFFICE

CERTIFICATE OF CORRECTION

PATENT NO. : 6,722,656 B2
DATED : April 20, 2004
INVENTOR(S) : Albert Heglund Jr.

It is certified that error appears in the above-identified patent and that said Letters Patent is hereby corrected as shown below:

Column 4,
Lines 11 and 12, delete "wherein the elongated sticks are at least as long as the distance from a waist of a user to the ground, and".
Line 29, between the words "opponent" and "said", insert the word -- in --.

Signed and Sealed this

Thirty-first Day of August, 2004

JON W. DUDAS
*Director of the United States Patent and Trademark Office*